US008750524B2

(12) United States Patent
Araki

(10) Patent No.: US 8,750,524 B2
(45) Date of Patent: Jun. 10, 2014

(54) AUDIO SIGNAL PROCESSING DEVICE AND AUDIO SIGNAL PROCESSING METHOD

(75) Inventor: Junji Araki, Osaka (JP)

(73) Assignee: Panasonic Corporation, Osaka (JP)

( * ) Notice: Subject to any disclaimer, the term of this patent is extended or adjusted under 35 U.S.C. 154(b) by 339 days.

(21) Appl. No.: 13/387,312

(22) PCT Filed: Oct. 29, 2010

(86) PCT No.: PCT/JP2010/006402

§ 371 (c)(1),
(2), (4) Date: Jan. 26, 2012

(87) PCT Pub. No.: WO2011/052226

PCT Pub. Date: May 5, 2011

(65) Prior Publication Data

US 2012/0121093 A1 May 17, 2012

(30) Foreign Application Priority Data

Nov. 2, 2009 (JP) ..... 2009-251687

(51) Int. Cl.
*H04R 5/00* (2006.01)

(52) U.S. Cl.
USPC ..... 381/17; 381/1

(58) Field of Classification Search
USPC ..... 381/1, 17, 18, 111, 300, 307, 309, 2, 381/310, 74; 700/94
See application file for complete search history.

(56) References Cited

U.S. PATENT DOCUMENTS 7,555,130 B2 * 6/2009 Klayman et al. ..... 381/1
2002/0006206 A1 1/2002 Scofield
2006/0008100 A1 * 1/2006 Kim et al. ..... 381/309
2008/0031462 A1 2/2008 Walsh et al.
2008/0187156 A1 8/2008 Yokota
2011/0026720 A1 * 2/2011 Ohta ..... 381/17

FOREIGN PATENT DOCUMENTS

JP 01-144900 A 6/1989
JP 08-280100 10/1996
JP 2006-303799 11/2006

(Continued)

OTHER PUBLICATIONS

International Search Report issued in International Patent Application No. PCT/JP2010/006402, mailed Feb. 8, 2011.

(Continued)

*Primary Examiner* — Vivian Chin
*Assistant Examiner* — Friedrich W Fahnert
(74) *Attorney, Agent, or Firm* — McDermott Will & Emery LLP

(57) ABSTRACT

When a correlation between an L channel and an R channel of a reproduction-target sound source is considerably high, virtual sound obtained from a reproduction signal is often more likely to be localized inside the head of a listener. A device includes: a correlation analysis unit (3) that analyzes a degree of correlation between a surround L channel signal (SL signal) and a surround R channel signal (SR signal); and an output signal control unit 4 that controls, based on the degree of correlation between the SL signal and the SR signal obtained as a result of the analysis performed by the correlation analysis unit (3), a ratio between: the signals outputted from a front L speaker (7) and a front R speaker (8); and the signals outputted from a near-ear L speaker (9) and a near-ear R speaker (10).

2 Claims, 6 Drawing Sheets

(56) References Cited

FOREIGN PATENT DOCUMENTS

| | | |
|---|---|---|
| JP | 2007-019940 | 1/2007 |
| JP | 2008-079065 | 4/2008 |
| WO | WO 2006/126473 A1 | 11/2006 |

OTHER PUBLICATIONS

Japanese Notice of Allowance dated Jul. 2, 2013, issued in corresponding Japanese Application No. 2011-538267.

* cited by examiner

| | Front speakers | Near-ear speakers |
|---|---|---|
| (1) | 0/8 | 8/8 |
| (2) | 1/8 | 7/8 |
| (3) | 2/8 | 6/8 |
| (4) | 3/8 | 5/8 |
| (5) | 4/8 | 4/8 |
| (6) | 5/8 | 3/8 |
| (7) | 6/8 | 2/8 |
| (8) | 7/8 | 1/8 |

AUDIO SIGNAL PROCESSING DEVICE AND AUDIO SIGNAL PROCESSING METHOD

RELATED APPLICATIONS

This application is the U.S. National Phase under 35 U.S.C. §371 of International Application No. PCT/JP2010/006402, filed on Oct. 29, 2010, which in turn claims the benefit of Japanese Application No. 2009-251687, filed on Nov. 2, 2009, the disclosures of which Applications are incorporated by reference herein.

TECHNICAL FIELD

The present invention relates to an audio signal processing technology for localizing sound using a head-related transfer function (HRTF). In particular, the present invention relates to an audio signal processing device and an audio signal processing method having a function of localizing virtual sound at a desired position using speakers placed in front of a listening position (referred to as the front speakers hereafter) and speakers placed near the ears of a listener (referred to as the near-ear speakers hereafter).

BACKGROUND ART

Conventional technologies of virtual sound localization include a method of localizing virtual sound in front of and behind a listener using an HRTF.

With this method, virtual sound is generated as follows.

Firstly, a speaker is placed at a desired position of virtual sound localization, and then an HRTF is measured from this speaker to the entrance of the external ear canal of the listener. This measured HRTF is set as a target characteristic. Following this, an HRTF is measured from a reproduction speaker to a listening position. Here, the reproduction speaker is used for reproducing a reproduction-target sound source. This measured HRTF is set as a reproduction characteristic. Note that the speaker placed at the desired position of virtual sound localization is used only for measuring the target characteristic and thus is not used for sound reproduction. Only the reproduction speaker is used for reproducing the reproduction-target sound source.

Then, an HRTF used in virtual sound localization is calculated from the target characteristic and the reproduction characteristic. The calculated HRTF is set as a filter characteristic. This filter characteristic is convoluted into the reproduction-target sound source which is then reproduced from the reproduction speaker. As a result, virtual sound localization can be implemented in such a manner that it seems to the listener as if the sound was reproduced from the speaker placed at the desired position of sound localization, although the sound is actually being reproduced from the reproduction speaker.

For generating the virtual sound as described above, there are two cases where: (1) reproduction speakers for reproducing the reproduction-target sound source are placed in front of the listener typically as in the case of a front virtual surround system; and (2) front speakers are placed in front of the listener and near-ear speakers are placed near the ears of the listener. A method for further increasing the accuracy in virtual sound localization by using the front speakers and the near-ear speakers is disclosed (see Patent Literature 1).

CITATION LIST

Patent Literature

[PTL 1]
Japanese Unexamined Patent Application Publication No. 2007-19940

SUMMARY OF INVENTION

Technical Problem

The aforementioned conventional method using the front speakers and the near-ear speakers, however, has the following problem. Suppose that a signal is reproduced using mainly the near-ear speakers which are physically closer to the listener and that there is an extremely high correlation between an L channel and an R channel of the reproduction-target sound source. In such a case, the virtual sound obtained from each reproduction signal of the L and R channels is less likely to be localized at the desired position, and is often more likely to be localized inside the head of the listener in a plane where distances from the right and left ears are the same. Thus, the virtual sound is not localized at the intended position, resulting in the problem that a sense of virtual sound localization cannot be adequately provided.

Solution to Problem

In order to solve the aforementioned conventional problem, the audio signal processing device according to an aspect of the present invention is an audio signal processing device by which a listener perceives sound reproduced by at least two real speakers placed in front of a listening position and at least two real speakers placed near ears of the listener as if the sound was reproduced by a virtual speaker imaginarily placed at a virtual position, the audio signal processing device including: an analysis unit which analyzes a degree of correlation between a pair of right and left input signals; and a control unit which controls, based on a result of the analysis performed by the analysis unit, a ratio between (i) signals outputted from the real speakers placed in front of the listening position and (ii) signals outputted from the real speakers placed near the ears of the listener.

With this configuration, the audio signal processing device according to an aspect of the present invention can control, based on the degree of correlation between the pair of right and left input signals, the ratio between: the input signals outputted from the real speakers placed in front of the listening position; and the input signals outputted from the real speakers placed near the ears of the listener. Therefore, depending on the degree of possible sound localization inside the head due to the characteristics of the pair of right and left input signals, the usage ratio between the near-ear speakers that easily localize the sound inside the head of the listener and the front speakers that hardly localize the sound inside the head of the listener can be determined. Thus, the sound can be more accurately localized at the desired position of the virtual speaker. Moreover, when the correlation between the pair of input signals is low and the sound source of the virtual sound is hard to be localized inside the head of the listener, control can be performed so that a higher proportion of each of the input signals is outputted from the near-ear speakers that are less influenced by, for example, a change in sound characteristics at the desired position of the virtual speaker depending on the room.

Moreover, the control unit may control the ratio so that: a higher proportion of each of the signals is outputted from the real speakers placed in front of the listening position when the degree of correlation is determined to be high as the result of the analysis performed by the analysis unit; and a higher proportion of each of the signals is outputted from the real speakers placed near the ears of the listener when the degree of correlation is determined to be low as the result of the analysis performed by the analysis unit.

With this configuration, the audio signal processing device in another aspect of the present invention can perform control so that a higher proportion of each of the input signals is outputted from the front speakers instead of the near-ear speakers when the input signals are more likely to be localized inside the head of the listener. Here, the sound from the front speakers is less likely to be localized inside the head of the listener whereas the sound from the near-ear speakers is more likely to be localized inside the head of the listener. In this way, the audio signal processing device achieves an advantageous effect by which the sound can be more accurately localized at the desired position of the virtual speaker. Moreover, when the correlation between the pair of input signals is low and the sound source of the virtual sound is hard to be localized inside the head of the listener, control can be performed so that a higher proportion of each of the input signals is outputted from the near-ear speakers that are less influenced by, for example, a change in sound characteristics at the desired position of the virtual speaker depending on the room.

Moreover, the audio signal processing device may further include a division unit which divides each of the input signals into a high frequency component having a frequency higher than a predetermined frequency and a low frequency component having a frequency equal to or lower than the predetermined frequency, wherein the analysis unit may analyze a degree of correlation between the high frequency components obtained as a result of the division performed on the input signals by the division unit, and the control unit may control the ratio so that: a higher proportion of each of the high frequency components is outputted from the real speakers placed in front of the listening position when the degree of correlation between the high frequency components is determined to be high as a result of the analysis performed by the analysis unit; and a higher proportion of each of the high frequency components is outputted from the real speakers placed near the ears of the listener when the degree of correlation between the high frequency components is determined to be low as the result of the analysis performed by the analysis unit.

With this configuration of the audio signal processing device in another aspect of the present invention, the low frequency components that cannot be outputted adequately from the speakers placed near the ears of the listener can be outputted from the speakers placed in front of the listening position. Moreover, when the degree of possible sound localization inside the head is higher, the audio signal processing device can perform control so that a higher proportion of each of the high frequency components that can be adequately outputted from the speakers placed near the ears of the listener is outputted from the speakers placed in front of the listening position instead of the near-ear speakers. Here, the sound from the speakers placed in front of the listening position is less likely to be localized inside the head of the listener whereas the sound from the speakers placed near the ears of the listener is more likely to be localized inside the head of the listener. Thus, the sound can be more accurately localized at the desired position of the virtual speaker.

It should be noted that the present invention can be implemented not only as a device, but also as: a method having, as steps, the processing units included in the device; a program causing a computer to execute the steps included in the method; a computer-readable recording medium, such as a CD-ROM, on which the program is recorded; and information, data, or a signal indicating the program. Moreover, the program, the information, the data, or the signal may be distributed via a communication network such as the Internet.

Advantageous Effects of Invention

The present invention is capable of preventing sound reproduced by the near-ear speakers from being localized inside the head of the listener and thus more accurately localizing virtual sound at a desired position.

DESCRIPTION OF EMBODIMENT

The following is a description of Embodiment, with reference to the drawings.

Figure 1:
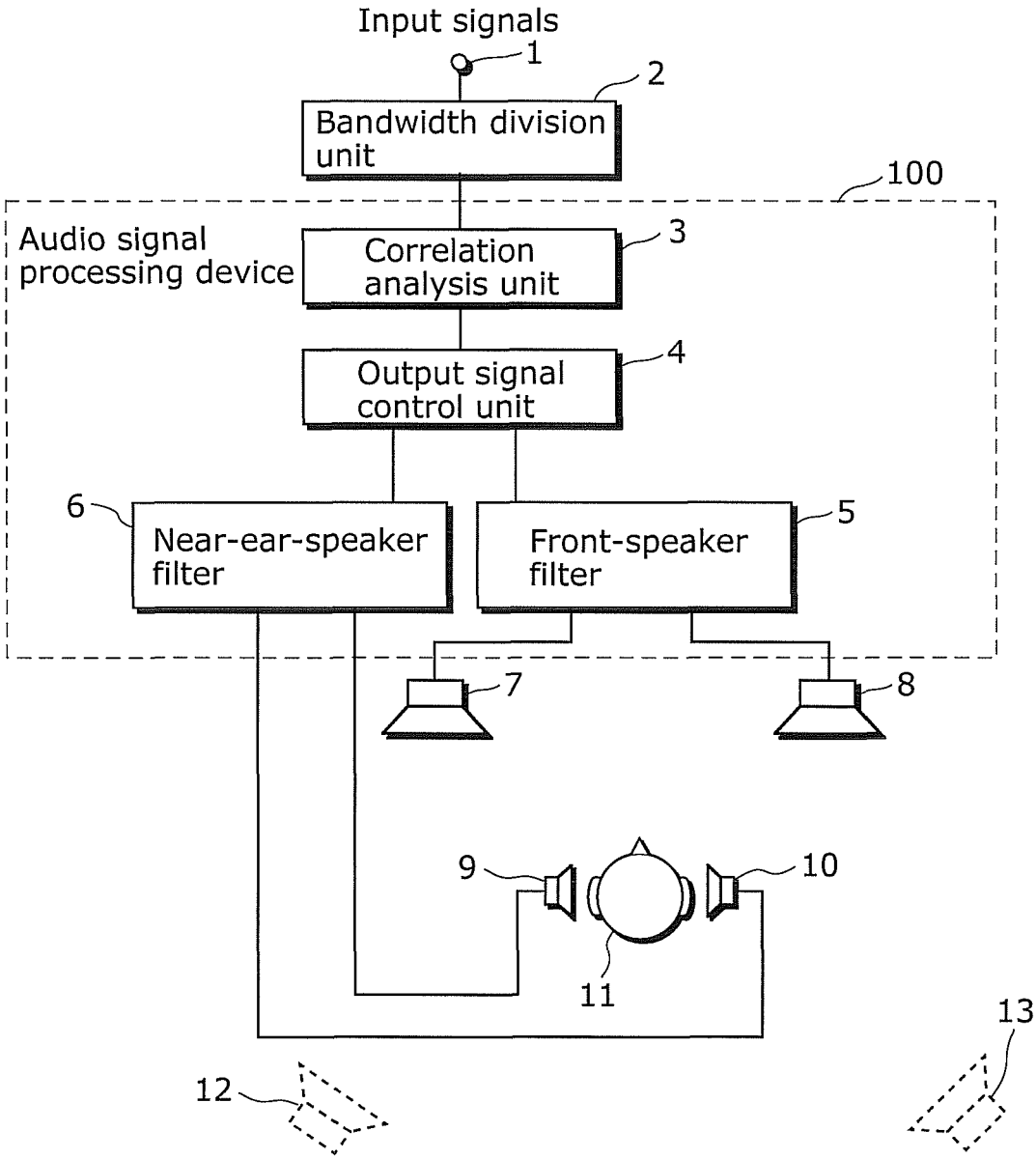
FIG. 1 is a block diagram showing a configuration of an audio signal processing device according to Embodiment.

FIG. 1 is a block diagram showing a configuration of an audio signal processing device according to Embodiment. An audio signal processing device 100 includes a correlation analysis unit 3, an output signal control unit 4, a front-speaker filter 5, and a near-ear-speaker filter 6. Moreover, the audio signal processing device 100 includes an input terminal 1 and a bandwidth division unit 2 in a previous stage, and also includes a front L speaker 7, a front R speaker 8, a near-ear L speaker 9, and a near-ear speaker 10 in a subsequent stage. It should be noted that, in the present invention, the bandwidth division unit 2 provided in the previous stage of the audio signal processing device 100 shown in FIG. 1 is not essential. In the case where the bandwidth division unit 2 is included, the bandwidth division unit 2 may be provided inside or outside the audio signal processing device 100. The following describes an example of the case where the bandwidth division unit 2 is not included. The audio signal processing device 100 reproduces a surround L channel signal (referred to as the SL signal hereafter) and a surround R channel signal (referred to as the SR signal hereafter) that are input signals, by using a pair of the front speakers 7 and 8 and a pair of the near-ear speakers 9 and 10. Accordingly, the audio signal processing device 100 localizes a virtual SL signal and a virtual SR signal at positions of a virtual surround L channel speaker (referred to as the virtual SL speaker hereafter) 12 and a virtual surround R channel speaker (referred to as the virtual SR speaker hereafter) 13, respectively.

As shown in FIG. 1, the SL signal and the SR signal are received as the input signals by the input terminal 1. The correlation analysis unit 3 analyzes a correlation between the input signals. The output signal control unit 4 controls destinations of the input signals, based on the result of the analysis performed by the correlation analysis unit 3. The front-speaker filter 5 performs filter processing on the SL signal and the SR signal received from the output signal control unit 4, using a front-speaker filter coefficient, and then outputs the resulting signals to the front L speaker 7 and the front R speaker 8. By the filter processing performed by the front-speaker filter 5 using the front-speaker filter coefficient, the SL signal is given a characteristic such that it seems to the listener as if the sound was reproduced at the position of the virtual SL speaker 12 although the SL signal is actually being reproduced by the front L speaker 7 and the front R speaker 8. Moreover, by this filter processing performed by the front-speaker filter 5, the SR signal is given a characteristic such that it seems to the listener as if the sound was reproduced at the position of the virtual SR speaker 13 although the SR signal is being reproduced by the front L speaker 7 and the front R speaker 8. The near-ear-speaker filter 6 performs filter processing on the SL signal and the SR signal received from the output signal control unit 4, using a near-ear-speaker filter coefficient, and then outputs the resulting signals to the near-ear L speaker 9 and the near-ear speaker 10. By the filter processing performed by the near-ear-speaker filter 6 using the near-ear-speaker filter coefficient, the SL signal is given a characteristic such that it seems to the listener as if the sound was reproduced at the position of the virtual SL speaker 12 although the SL signal is being reproduced by the near-ear L speaker 9 and the near-ear speaker 10. Moreover, by this filter processing performed by the near-ear-speaker filter 6, the SR signal is given a characteristic such that it seems to the listener as if the sound was reproduced at the position of the virtual SR speaker 13 although the SR signal is being reproduced by the near-ear L speaker 9 and the near-ear speaker 10. With the audio signal processing device configured as described, when listening to the sound outputted from the front speakers 7 and 8 and the near-ear speakers 9 and 10, a listener 11 perceives the reproduced sound virtually from the positions of the virtual SL speaker 12 and the virtual SR speaker 13 which do not exist.

The sound localization processing performed as described above is explained below.

Figure 2:
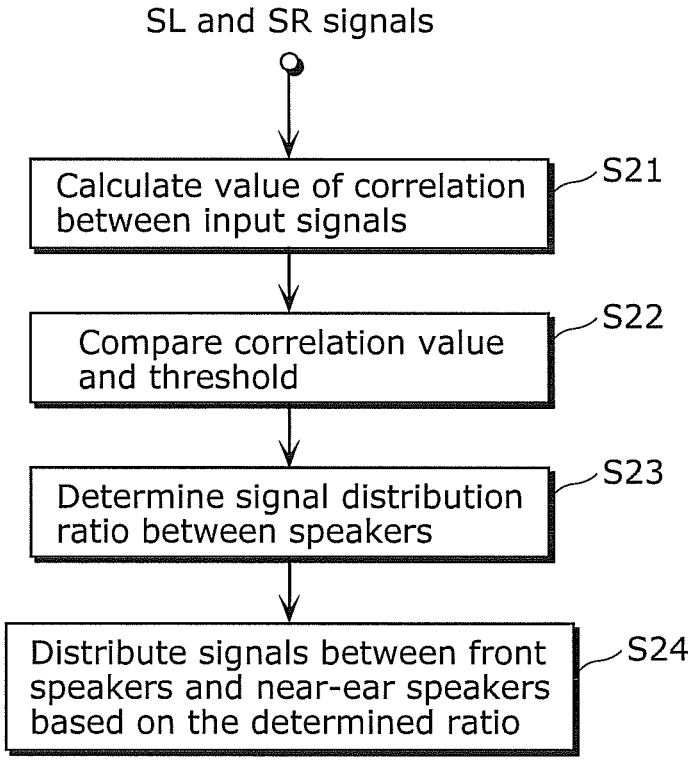
FIG. 2 is a flowchart showing an example of an operation performed by the audio signal processing device according to Embodiment.

Firstly, the correlation analysis unit 3 is described. FIG. 2 is a flowchart showing an example of an operation performed by the audio signal processing device according to Embodiment. The correlation analysis unit 3 performs processing on the target input signals, i.e., the SL signal and the SR signal, to calculate a cross-correlation function of these two signals according to Equation 1 below (S21).

The cross-correlation function may be calculated on a time domain basis as in Equation 1, or may be calculated on a frequency domain basis after fast Fourier transform (FFT) is performed on a time waveform.

[Math. 1]

$$\phi_{12}(\tau) = \frac{\int g_1(x)g_2(x-\tau)dx}{\sqrt{\int (g_1(x))^2 dx \int (g_2(x))^2 dx}} \quad \text{Equation 1}$$

Here, $\phi_{12}(\tau)$ represents a correlation value which is an output of the cross-correlation function, and indicates a higher correlation when the value is larger. Moreover, $g_1(\ )$ and $g_2(\ )$ represent the input SL signal and the input SR signal, respectively, and $\tau$ represents a delay between $g_1(\ )$ and $g_2(\ )$ on a time axis. To be more specific, when only the case where $\tau=0$ is considered, this means that the correlation value of when these two signals are in the same phase is calculated. Hence, $\phi_{12}(\tau)$ has only one output value. On the other hand, when the case where $\tau=n$ is considered, $\phi_{12}(\tau)$ has $(2*n+1)$ output values. In this case, the maximum value is determined as the output value of $\phi_{12}(\tau)$. It should be noted that since Equation 1 is normalized, $0 \le \phi_{12}(\tau) \le 1$.

Following this, the correlation analysis unit 3 compares the obtained output value of the cross-correlation function $\phi_{12}(\tau)$ and a threshold S (S22). When the output value of the cross-correlation function $\phi_{12}(\tau)$ is larger than the threshold S as a result of the comparison, the correlation analysis unit 3 determines that the correlation is high. When the output value of the cross-correlation function $\phi_{12}(\tau)$ is smaller than the threshold S, the correlation analysis unit 3 determines that the correlation is low. Here, the threshold S is determined as follows, for example. With the virtual sound generation method using the near-ear speakers, a relationship between a correlation value of the signals and the accuracy in virtual sound localization is identified in advance by a subjective evaluation experiment or the like. Then, the maximum correlation value at which the virtual sound is not localized any more is used as the threshold S. Thus, the correlation analysis unit 3 sends, to the output signal control unit 4, the result of analyzing the correlation and also the input signals received from the bandwidth division unit 2.

Next, an operation performed by the output signal control unit 4 is described.

Figures 3A, 3B:
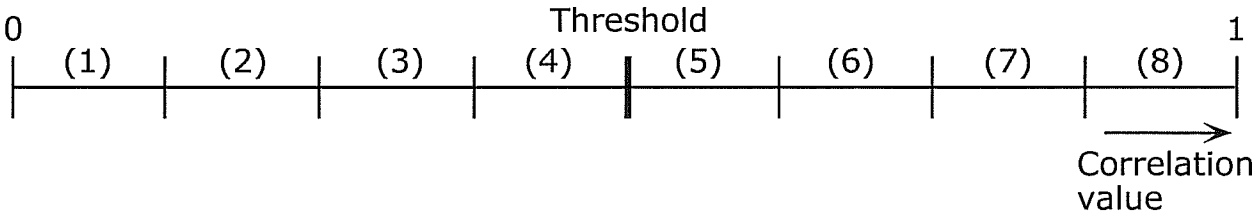
FIG. 3 shows, in each of (a) and (b), an example of data to be used in processing performed by a correlation analysis unit and an output signal control unit included in the audio signal processing device according to Embodiment.

FIG. 3 shows, in each of (a) and (b), an example of data to be used in processing performed by the correlation analysis unit and the output signal control unit included in the audio signal processing device according to Embodiment. In FIG. 3, (a) shows sections of the correlation value used in assigning a distribution ratio, corresponding to the correlation value calculated by the correlation analysis unit 3. The distribution ratio refers to proportions of the signal to be distributed to the front speakers and the near-ear speakers. For example, as shown in (a) of FIG. 3, a possible range of the correlation value is divided into eight sections and a proportion is assigned to each of the divided sections. In the present example, for the correlation value taking on the values from 0 to 1, the threshold S is set as the boundary between the range of the sections (1) to (4) where the correlation value is smaller than the threshold S and the range of the sections (5) to (8) where the correlation value is equal to or larger than the threshold S. Then, a predetermined proportion is assigned for each of the sections. It should be noted that the value of the threshold S is not necessarily "0.5", and that the ranges before and after the boundary are not necessarily divided equally to each other. For example, the range where the correlation value is smaller than the threshold S may be divided by a larger section width, that is, divided into a smaller number of sections as compared with the range where the correlation value is larger than the threshold S. Moreover, the range where the correlation value is larger than the threshold S may be divided by a smaller section width, that is, divided into a larger number of sections as compared with the range where the correlation value is smaller than the threshold S. Furthermore, the section width may be smaller as the correlation value is closer to the threshold S and larger as the correlation value is farther from the threshold S.

In the above example, the processing performed by the correlation analysis unit 3 in S22 to compare the correlation value and the threshold S refers to processing of detecting which one of the sections shown in (a) of FIG. 3 corresponds to the correlation value calculated using the correlation function.

Next, the output signal control unit 4 performs control so that a higher proportion of each of the SL signal and the SR signal is outputted from the near-ear speakers when the calculated correlation value is smaller. This is because the correlation between the SL signal and the SR signal is lower when the correlation value calculated using the correlation function is smaller than the threshold S. Moreover, the output signal control unit 4 performs control so that a higher proportion of each of the SL signal and the SR signal is outputted from the front speakers when the calculated correlation value is larger than the threshold S. This is because the correlation between the SL signal and the SR signal is higher when the correlation value is larger than the threshold S.

The output signal control unit 4 performs the above control by reference to a table indicating the correlation values each representing a boundary between the sections shown in (a) of FIG. 3 and also indicating an assigned distribution ratio for each of the sections. In FIG. 3, (b) shows a signal distribution ratio between the front speakers and the near-ear speakers for each of the correlation value sections divided as shown in (a) of FIG. 3.

As shown in (b) of FIG. 3, in a section (1) where the correlation value is the smallest, a proportion of the signal assigned to the front speakers is 0/8 and a proportion of the signal assigned to the near-ear speakers is 8/8. To be more specific, in this case, the near-ear speakers output the entire SL signal and the entire SR signal and the front speakers do not output the signals. When the correlation between the SL signal and the SR signal is low, this means that a degree of similarity in sound between the SL signal and the SR signal is low and that, in many cases, each of the SL signal and the SR signal is recognizable as an independent sound. Thus, as a result of the sound localization processing by the near-ear-speaker filter 6, it is hard for the sound to be localized inside the head of the listener. On account of this, when the correlation between the SL signal and the SR signal is low, the near-ear L speaker 9 and the near-ear R speaker 10 output the SL signal and the SR signal instead of the front L speaker 7 and the front R speaker 8 that are more influenced by, for example, a change in sound characteristics depending on the room. As a result, an advantageous effect can be achieved such that the listener can more accurately perceive the sound source at the positions of the virtual SL speaker 12 and the virtual SR speaker 13.

In a section (8) where the correlation between the SL signal and the SR signal is the highest, a proportion of the signal assigned to the front speakers is 7/8 and a proportion of the signal assigned to the near-ear speakers is 1/8. To be more specific, in this case, the front speakers output 7/8 of each of the SL signal and the SR signal and the near-ear speakers output 1/8 of the each of the signals. When the correlation between the SL signal and the SR signal is high, this means that the degree of similarity in sound between the SL signal and the SR signal is high and that the sound is close to monophonic sound. Thus, when outputted from the near-ear speakers, the sound is likely to be localized in the center of the head of the listener. On account of this, when the correlation between the SL signal and the SR signal is high, control is performed so that the front L speaker 7 and the front R speaker 8 output most of the signals instead of the near-ear L speaker 9 and the near-ear R speaker 10 that easily localize the sound inside the head of the listener. The front-speaker filter 5 performs the front-speaker filter processing on the received SL signal and the received SR signal to implement virtual sound localization, and then the resulting SL signal and the resulting SR signal are outputted from the front L speaker 7 and the front R speaker 8. As a result, the sound is prevented from being localized in the center of the head of the listener and, by the sound localization processing of the front-speaker filter 5, an advantageous effect can be achieved such that the listener can perceive the virtual sound at the positions of the virtual SL speaker 12 and the virtual SR speaker 13.

In a section (5) where the value of correlation between the SL signal and the SR signal is close to the threshold S, a proportion of the signal assigned to the front speakers is 4/8 and a proportion of the signal assigned to the near-ear speakers is 4/8. The near-ear-speaker filter 6 performs the coefficient processing on the received SL signal and the received SR signal to implement virtual sound localization, and then the resulting SL signal and the resulting SR signal are outputted from the near-ear L speaker 9 and the near-ear R speaker 10. Moreover, the front-speaker filter 5 performs the front-speaker filter processing on the received SL signal and the received SR signal to implement virtual sound localization, and then the resulting SL signal and the resulting SR signal are outputted from the front L speaker 7 and the front R speaker 8. As a result, the listener can perceive the virtual sound at the positions of the virtual SL speaker 12 and the virtual SR speaker 13.

In the example shown in FIG. 3, the range of the correlation value from 0 to 1 is divided into eight sections. However, the number of sections is not limited to eight, and may be any number. Moreover, in the above example, the output signal control unit 4 stores the table as shown in (b) of FIG. 3. However, the output signal control unit 4 does not necessarily need to store the table. Instead of referencing to the table, the output signal control unit 4 may use the correlation value ranging from 0 to 1, as it is, as the signal distribution ratio assigned to the near-ear speakers and the front speakers. Alternatively, the distribution ratio may be determined by calculating a ratio between: a distance from the threshold S to the correlation value calculated by the correlation analysis unit 3; and a distance from the threshold S to 0 (a distance from the threshold S to 1 when the correlation value is larger than the threshold S). Or, the output signal control unit 4 may determine the distribution ratio by substituting the correlation value calculated by the correlation analysis unit 3 into a predetermined function. Moreover, in (b) of FIG. 3, the distribution ratios ranging from [Front speakers: 0/8, Near-ear speakers: 8/8] to [Front speakers: 7/8, Near-ear speakers: 1/8] are assigned, corresponding to the sections (1) to (8) of the correlation value. However, the present invention is not limited to this. For example, even in the section (1) where the correlation value is the smallest, the distribution ratio may be [Front speakers: 2/8, Near-ear speakers: 6/8], so that the proportion assigned to the front speakers is not zero. Moreover, even in the section (8) where the correlation value is the largest, the distribution ratio may be [Front speakers: 6, Near-ear speakers: 2], so that a proportion to some extent is assigned to the near-ear speakers. Alternatively, in the section (8) where the correlation value is the largest, the proportion assigned to the near-ear speakers may be zero as in the distribution ratio expressed by [Front speakers: 8, Near-ear speakers: 0].

Figure 4:
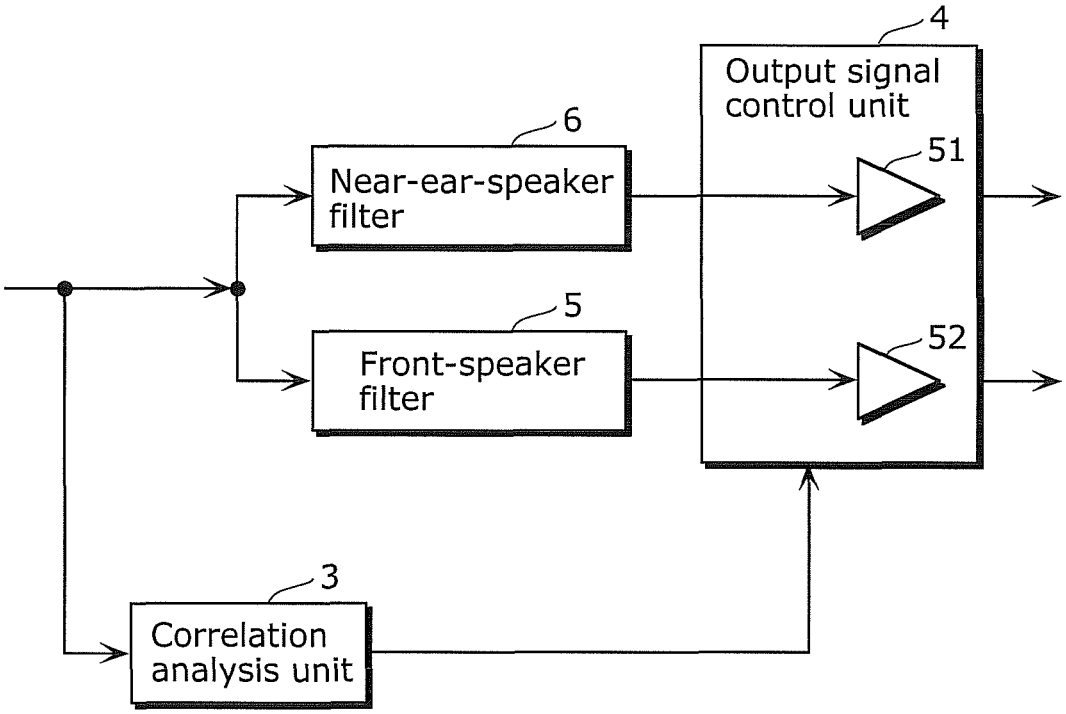
FIG. 4 is a block diagram showing an example of a more detailed configuration of the audio signal processing device according to Embodiment.

In this way, the output signal control unit 4 controls the signal distribution ratio between the near-ear speakers and the front speakers based on the value of correlation between the SL signal and the SR signal calculated by the correlation analysis unit 3. This output signal control unit 4 may be provided after the stage of the near-ear-speaker filter 6 and the front-speaker filter 5. FIG. 4 is a block diagram showing an example of a more detailed configuration of the audio signal processing device according to Embodiment. As shown in FIG. 4, the output signal control unit 4 may include an amplifier 51 and an amplifier 52 each capable of variably controlling an amplification factor based on the correlation value received from the correlation analysis unit 3. The amplifier 51 amplifies the SL signal on which the filter processing has been performed by the near-ear-speaker filter 6, according to the distribution ratio determined by the output signal control unit 4, and then outputs the amplified signal to the near-ear L speaker 9 and the near-ear speaker 10. The amplifier 52 amplifies the SL signal on which the filter processing has been performed by the front-speaker filter 5, according to the distribution ratio determined by the output signal control unit 4, and then outputs the amplified signal to the front L speaker 7 and the front R speaker 8. Similarly, the amplifier 51 amplifies the SR signal on which the filter processing has been performed by the near-ear-speaker filter 6, according to the distribution ratio determined by the output signal control unit 4 (the same distribution ratio as in the case of the SL signal), and then outputs the amplified signal to the near-ear L speaker 9 and the near-ear speaker 10. The amplifier 52 amplifies the SR signal on which the filter processing has been performed by the front-speaker filter 5, according to the distribution ratio determined by the output signal control unit 4 (the same distribution ratio as in the case of the SL signal), and then outputs the amplified signal to the front L speaker 7 and the front R speaker 8.

Figure 5:
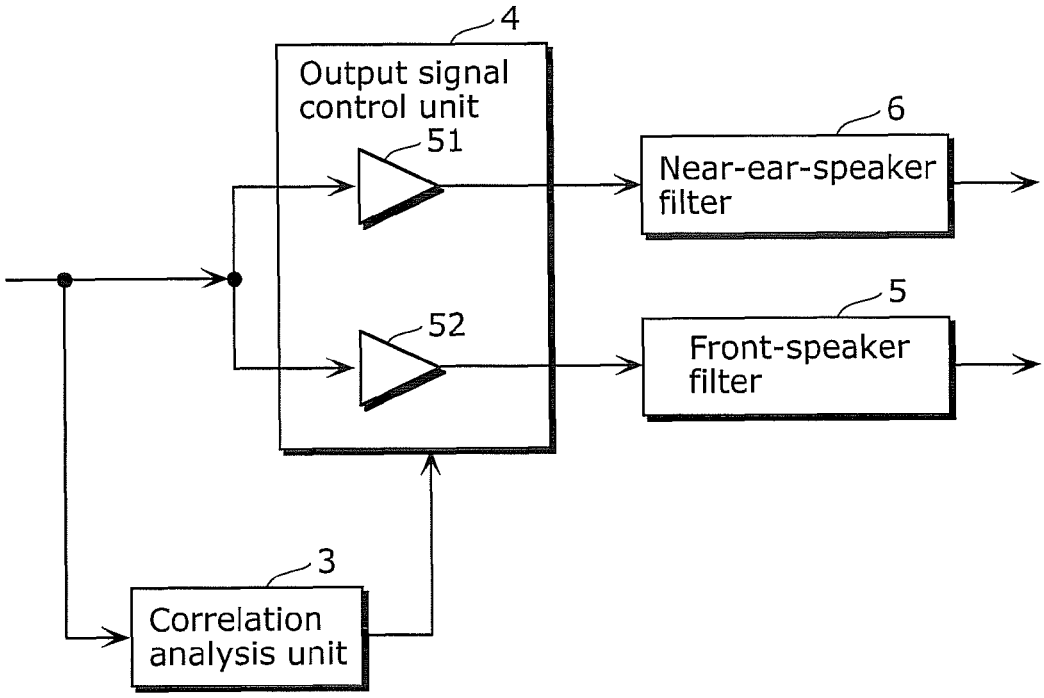
FIG. 5 is a block diagram showing another example of a more detailed configuration of the audio signal processing device according to Embodiment.

The output signal control unit 4 controls the signal distribution ratio between the near-ear speakers and the front speakers based on the correlation value. This output signal control unit 4 may be provided before the stage of the near-ear-speaker filter 6 and the front-speaker filter 5. FIG. 5 is a block diagram showing another example of a more detailed configuration of the audio signal processing device according to Embodiment. As shown in FIG. 5, the output signal control unit 4 may include an amplifier 51 and an amplifier 52 each capable of variably controlling an amplification factor based on the correlation value received from the correlation analysis unit 3. The amplifier 51 and the amplifier 52 amplify the received SL signals according to the distribution ratio determined by the output signal control unit 4, and then output the amplified signals to the near-ear-speaker filter 6 and the front-speaker filter 5, respectively. Similarly, the amplifier 51 and the amplifier 52 amplify the received SR signals according to the distribution ratio determined by the output signal control unit 4 (the same distribution ratio as in the case of the SL signal), and then output the amplified signals to the near-ear-speaker filter 6 and the front-speaker filter 5, respectively.

As shown in FIG. 4 and FIG. 5, regardless of whether the output signal control unit 4 is provided before or after the stage of the front-speaker filter 5 and the near-ear-speaker filter 6, the same advantageous effect can be achieved.

In the above example, control is performed so that the ratio between the signals outputted from the front speakers and the signals outputted from the near-ear speakers is changed based on the degree of correlation between the SL signal and the SR signal. However, the present invention is not limited to this. For example, control may be performed so that the SL signal and the SR signal are outputted from either the front speakers or the near-ear speakers based on a result of a comparison between the correlation value and the threshold S.

The following describes an example where the bandwidth division unit 2 divides each of the SL signal and the SR signal into a high frequency band a low frequency band. Then, in the following example, control is performed so that the low frequency signals are outputted always from the front speakers and that the high frequency signals are outputted: from the front speakers when the correlation between the SL signal and the SR signal is high; and from the near-ear speakers when the correlation between the SL signal and the SR signal is low.

Firstly, the bandwidth division unit 2 is described.

The bandwidth division unit 2 performs bandwidth division on the SL signal and the SR signal received from the input terminal 1, based on the degree of accuracy in sound localization. In bandwidth division, the bandwidth division unit 2 divides each of the input signals into a high frequency band (typically 1 kHz and higher) significantly influencing the degree of accuracy in sound localization and a low frequency band lower than the high frequency band. The bandwidth division unit 2 may be configured to divide the input signal into the bands using a predetermined frequency as a boundary in this way, or may be configured with a combination of a low-pass filter and a high-pass filter.

The signals obtained as a result of the bandwidth division performed by the bandwidth division unit 2 are sent to the correlation analysis unit 3. The correlation analysis unit 3 analyzes the correlation in high frequency band between the SL signal and the SR signal received from the bandwidth division unit 2.

Regardless of the correlation between the SL and SR signals, the low frequency signals obtained as a result of the bandwidth division performed by the bandwidth division unit 2 are outputted from the front speakers having high performance in low frequency reproduction. Of the front L speaker 7, the front R speaker 8, the near-ear L speaker 9, and the near-ear R speaker 10, the front L speaker 7 and the front R speaker 8 have high performance in low frequency reproduction. Thus, without the correlation analysis, the low frequency signals are sent to the output signal control unit 4 and then to the front-speaker filter 5. It should be obvious that the low frequency signals obtained as a result of the bandwidth division performed by the bandwidth division unit 2 may be sent, as they are, to the front-speaker filter 5 as the output result given by the bandwidth division unit 2.

The bandwidth division unit 2 makes the following determinations to determine which speakers are appropriate for reproducing the high frequency signals obtained as a result of the bandwidth division. To be more specific, the bandwidth division unit 2 determines whether the high frequency signals are to be reproduced by the front speakers or the near-ear speakers.

Hereafter, for the sake of simplicity, the high-frequency SL signal and the high-frequency SR signal are referred to as the SL signal and the SR signal, respectively.

Figure 6:
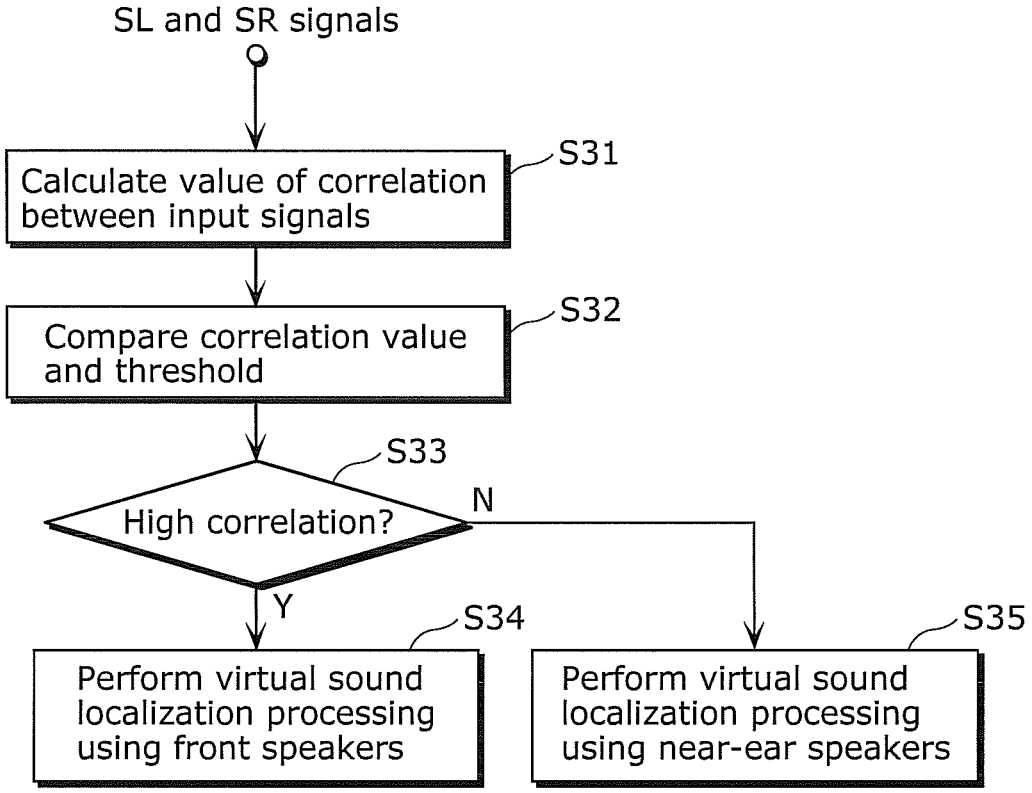
FIG. 6 is a flowchart showing another example of an operation performed by the audio signal processing device according to Embodiment.

Next, the correlation analysis unit 3 is described. FIG. 6 is a flowchart showing another example of an operation performed by the audio signal processing device according to Embodiment. The correlation analysis unit 3 performs processing on the target signals, i.e., the SL signal and the SR signal received from the bandwidth division unit 2, to calculate a cross-correlation function of these two signals according to Equation 1 (S31). The cross-correlation function may be calculated on a time domain basis as in Equation 1, or may be calculated on a frequency domain basis after fast Fourier transform (FFT) is performed on a time waveform.

In Equation 1 of this case, $g_1(\ )$ and $g_2(\ )$ respectively represent the SL signal and the SR signal obtained as a result of the bandwidth division performed by the bandwidth division unit 2, and $\tau$ represents a delay between $g_1(\ )$ and $g_2(\ )$ on a time axis.

Following this, the correlation analysis unit 3 compares the obtained output value of the cross-correlation function $\phi_{12}(\tau)$ and a threshold S (S32). The correlation analysis unit 3 determines that the correlation is high when the output value of the cross-correlation function $\phi_{12}(\tau)$ is larger than the threshold S, and determines that the correlation is low when the output value of the cross-correlation function $\phi_{12}(\tau)$ is equal to or smaller than the threshold S (S33). Then, the correlation analysis unit 3 sends, to the output signal control unit 4, the result of analyzing the correlation and also the input signals received from the bandwidth division unit 2.

Next, an operation performed by the output signal control unit 4 is described.

When it is determined that the correlation is high as a result of the analysis performed by the correlation analysis unit 3 (Yes in S33), the output signal control unit 4 sends the SL signal and the SR signal to the front-speaker filter 5 (S34). Moreover, the output signal control unit 4 sends, to the front-speaker filter 5, the low-frequency SL signal and the low-frequency SR signal obtained as a result of the bandwidth division performed by the bandwidth division unit 2.

The front-speaker filter 5 performs the front-speaker filter processing on the received SL signal and the received SR signal to implement virtual sound localization, and then the resulting SL signal and the resulting SR signal are outputted from the front L speaker 7 and the front R speaker 8. As a result, the listener can perceive the virtual sound at the positions of the virtual SL speaker 12 and the virtual SR speaker 13.

When it is determined that the correlation is low as a result of the analysis performed by the correlation analysis unit 3 (No in S33), the output signal control unit 4 sends the SL signal and the SR signal to the near-ear-speaker filter 6 (S35).

The near-ear-speaker filter 6 performs the filter processing on the received SL signal and the received SR signal using the near-ear-speaker filter coefficient to implement virtual sound localization, and then the resulting SL signal and the resulting SR signal are outputted from the near-ear L speaker 9 and the near-ear R speaker 10. As a result, the listener can perceive the virtual sound at the positions of the virtual SL speaker 12 and the virtual SR speaker 13.

Note that the bandwidth division unit 2 in Embodiment does not necessarily divide the signal into two frequency bands, that is, high and low frequency bands. The bandwidth division unit 2 may divide the signal into more than two frequency bands.

Moreover, the correlation analysis unit 3 may analyze the correlation only in high frequency band and a predetermined frequency band between the input signals received from the bandwidth division unit 2. Then, the correlation analysis unit 3 may send a result of this analysis to the output signal control unit 4, determining that the correlation is low in other frequency bands. Furthermore, the bandwidth division unit 2 may send, to the correlation analysis unit 3, only the input signals which are targets for correlation analysis. Alternatively, the bandwidth division unit 2 may send the entire input signals to the correlation analysis unit 3.

In Embodiment described above, the near-ear-speaker filter 6 and the front-speaker filter 5 are included in the audio signal processing device 100. However, when the near-ear-speaker filter 6 and the front-speaker filter 5 are provided after the stage of the output signal control unit 4, these filters 5 and 6 may be provided outside the audio signal processing device 100.

In Embodiment described above, the bandwidth division unit 2 divides each of the SL signal and the SR signal into high and low frequency bands, and then control is performed so that: the low frequency signals are outputted always from the front speakers; and the high frequency signals are outputted from the near-ear speakers when the value of the correlation between the SL signal and the SR signal is equal to or smaller than the threshold and outputted from the front speakers when the value of the correlation between the SL signal and the SR signal is larger than the threshold. However, the present invention is not limited to this. For example, it should be obvious that the high-frequency SL signal and the high-frequency SR signal obtained as a result of the bandwidth division performed by the bandwidth division unit 2 may be distributed between the front speakers and the near-ear speakers according to a ratio depending on the degree of correlation between the high-frequency SL signal and the high-frequency SR signal.

Explanation of Terms

The correlation analysis unit 3 in Embodiment described above corresponds to an analysis unit that analyzes a degree of correlation between input signals. The output signal control unit 4 corresponds to a control unit that controls, based on a result of the analysis performed by the correlation analysis unit 3, a ratio between: the input signals outputted from real speakers placed in front of a listening position; and the input signals outputted from real speakers placed near the ears of the listener. The bandwidth division unit 2 corresponds to a division unit that divides each of a pair of the input signals into a high frequency component having a frequency higher than a predetermined frequency and a low frequency component having a frequency equal to or lower than the predetermined frequency.

It should be noted that each of the function blocks shown in the block diagrams (FIGS. 1, 5, and 6, for example) is implemented into a large scale integration (LSI) which is typically an integrated circuit. The function blocks may be integrated into individual chips or some or all of them may be integrated into one chip.

For example, the function blocks except for the memory may be integrated into a single chip.

Although referred to as the LSI here, the integrated circuit may be referred to as an integrated circuit (IC), a system LSI, a super LSI, or an ultra LSI depending on the degree of integration.

A method for circuit integration is not limited to application of an LSI. It may be implemented as a dedicated circuit or a general-purpose processor. It is also possible to use a Field Programmable Gate Array (FPGA) that can be programmed after the LSI is manufactured, or a reconfigurable processor in which connection and setting of circuit cells inside the LSI can be reconfigured.

Moreover, when a circuit integration technology that replaces LSIs comes along owing to advances of the semiconductor technology or to a separate derivative technology, the function blocks should be understandably integrated using that technology. There can be a possibility of adaptation of biotechnology, for example.

Furthermore, of all the function blocks, only the unit storing data which is to be coded or decoded may not be integrated into the single chip and thus separately configured.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

Industrial Applicability

The present invention is applicable to an apparatus having a device capable of reproducing a music signal and driving two or more pairs of speakers. In particular, the present invention is applicable to a surround system, a TV, an AV amplifier, a component stereo, a cellular phone, and a portable audio device, for example.

| Reference Signs List | |
|---|---|
| 1 | Input terminal |
| 2 | Bandwidth division unit |
| 3 | Correlation analysis unit |
| 4 | Output signal control unit |
| 5 | Front-speaker filter |
| 6 | Near-ear-speaker filter |
| 7 | Front L speaker |
| 8 | Front R speaker |
| 9 | Near-ear L speaker |
| 10 | Near-ear R speaker |
| 11 | Listener |
| 12 | Virtual SL speaker |
| 13 | Virtual SR speaker |

The invention claimed is:

1. An audio signal processing device by which a listener perceives sound reproduced by at least two real speakers placed in front of a listening position and at least two real speakers placed near ears of the listener as if the sound was reproduced by a virtual speaker imaginarily placed at a virtual position, said audio signal processing device comprising:

an analysis unit configured to analyze a degree of correlation between a pair of right and left input signals;

a control unit configured to control, based on a result of the analysis performed by said analysis unit, a ratio between (i) signals outputted from the real speakers placed in front of the listening position and (ii) signals outputted from the real speakers placed near the ears of the listener; and a division unit configured to divide each of the input signals into a high frequency component having a frequency higher than a predetermined frequency and a low frequency component having a frequency equal to or lower than the predetermined frequency, wherein said analysis unit is configured to analyze a degree of correlation between the high frequency components obtained as a result of the division performed on the input signals by said division unit, and said control unit is configured to control the ratio so that: a higher proportion of each of the high frequency components is outputted from the real speakers placed in front of the listening position when the degree of correlation between the high frequency components is determined to be high as a result of the analysis performed by said analysis unit; and a higher proportion of each of the high frequency components is outputted from the real speakers placed near the ears of the listener when the degree of correlation between the high frequency components is determined to be low as the result of the analysis performed by said analysis unit.

2. An audio signal processing method by which a listener perceives sound reproduced by at least two real speakers placed in front of a listening position and at least two real speakers placed near ears of the listener as if the sound was reproduced by a virtual speaker imaginarily placed at a virtual position, said audio signal processing method comprising:

analyzing a degree of correlation between a pair of right and left input signals;

controlling, based on a result of the analysis performed in said analyzing, a ratio between (i) signals outputted from the real speakers placed in front of the listening position and (ii) signals outputted from the real speakers placed near the ears of the listener; and dividing each of the input signals into a high frequency component having a frequency higher than a predetermined frequency and a low frequency component having a frequency equal to or lower than the predetermined frequency, wherein, in said analyzing, a degree of correlation between the high frequency components obtained in said dividing is analyzed, and in said controlling, the ratio is controlled so that: a higher proportion of each of the high frequency components is outputted from the real speakers placed in front of the listening position when the degree of correlation between the high frequency components is determined to be high in said analyzing; and a higher proportion of each of the high frequency components is outputted from the real speakers placed near the ears of the listener when the degree of correlation between the high frequency components is determined to be low in said analyzing.

* * * * *